United States Patent [19]

Sproul et al.

[11] Patent Number: 4,832,129

[45] Date of Patent: May 23, 1989

[54] MULTI-POSITION TOOL AND METHOD FOR RUNNING AND SETTING A PACKER

[75] Inventors: Richard M. Sproul, Grapevine; Frank Giusti, Jr., Lewisville; Carter R. Young, Highland Village, all of Tex.; John B. Wilkie, Jr., Houma, La.

[73] Assignee: Otis Engineering Corporation, Carrollton, Tex.

[21] Appl. No.: 100,029

[22] Filed: Sep. 23, 1987

[51] Int. Cl.[4] ..... E21B 23/06; E21B 33/129

[52] U.S. Cl. ..... 166/387; 166/120; 166/123

[58] Field of Search ..... 166/120, 123, 125, 181, 166/182, 387, 278

[56] References Cited

U.S. PATENT DOCUMENTS

| | | | |
|---|---|---|---|
| 3,987,854 | 10/1976 | Callihan et al. | 166/278 |
| 4,345,649 | 8/1982 | Baugh et al. | 166/120 |
| 4,516,634 | 5/1985 | Pitts | 166/125 X |
| 4,540,051 | 9/1985 | Schmuck et al. | 166/278 |
| 4,541,486 | 9/1985 | Wetzel et al. | 166/297 |
| 4,566,538 | 1/1986 | Peterson | 166/278 |
| 4,664,188 | 5/1987 | Zunkel et al. | 166/182 X |
| 4,688,634 | 8/1987 | Lustig et al. | 166/181 X |

*Primary Examiner*—Jerome W. Massie
*Assistant Examiner*—David J. Bagnell
*Attorney, Agent, or Firm*—Dennis T. Griggs

[57] ABSTRACT

A packer is locked onto a service tool by separation shear pins during a run-in operation. The separation shear pins are decoupled with respect to run-in handling forces by a set of transfer support lugs. The transfer support lugs carry the weight of the packer and the hang weight of equipment supported by the packer so that no weight is applied to the shear pins during a run-in operation. The packer is set and its hang load is transferred to the separation shear pins after the packer is set by the application of hydraulic pressure against an annular piston carried on the service tool. The piston is locked during run-in by a group of transit shear pins. Movement of the annular piston shears the transit pins and unsupports a collet latch to permit retraction of the transfer support lugs and disengagement of the service tool mandrel from the packer. The service tool is then released from the packer by increasing hydraulic pressure or by pulling up on the work string, or both, and shearing the separation shear pins. Upon release, the service tool can be reciprocated freely within the packer bore for accommodating a gravel pack service operation.

12 Claims, 3 Drawing Sheets

MULTI-POSITION TOOL AND METHOD FOR RUNNING AND SETTING A PACKER

FIELD OF THE INVENTION

This invention relates to tools and equipment for servicing downhole wells, and in particular to a hydraulically operable, multi-position service tool for running and setting a packer in a well bore.

BACKGROUND OF THE INVENTION

In the course of treating and preparing subterranean wells for production, a well packer and screen along with a service tool are run into the well on a work string, with the packer being set against a casing bore.

It is necessary to manipulate the service tool within the well to set, position or release downhole equipment. The success of such operations is dependent upon the ability to reciprocate the tool vertically or to rotate it relative to the downhole equipment. Rotational displacement of the tool in deviated wells is difficult to perform reliably because of frictional binding between the work string and the well casing. Accordingly, up and down reciprocal movements are preferred for setting and releasing downhole equipment in such instances.

During run-in, the packer is mechanically locked in the unset condition by shear pins. The shear pins support the weight of the packer along with the hang weight of other components such as a swivel shear sub, blank pipe, sand screen, polished nipple, tail screen, sealing unit and sump packer. The shear pins can safely support the combined weight of the downhole equipment, and are rated to yield to a preset shearing force to separate and release the service unit after the packer has been set. In deviated or otherwise obstructed well bores, the shear pins may be damaged and the packer may sometimes be inadvertently preset in response to frictional loading between the packer and the well bore in tight spots.

DESCRIPTION OF THE PRIOR ART

When operating in slanted or deviated bore holes, it is sometimes difficult to transmit sufficient force downhole from the surface to set mechanically actuated packers. The frictional engagement caused by the bore hole deviation interferes with the transmission of the necessary mechanical force to set the packer. In such applications, it is desirable to use a packer in which the required packer setting force is developed by hydraulic transmission. The packer is maintained in the unset condition by shear pins which lock the packer to the work string. It will be appreciated that pre-stressing of the shear pins and premature setting of the packer may occur as a result of binding movement of the packer along a slanted or deviated bore hole.

Some packers require the application of torque to apply setting force to the slips. Such packers are difficult to set in slanted and in deviated holes because of binding engagement of the work string against the well bore.

Additionally, when a substantial load of downhole equipment is hung off of the packer, there is a risk that the shear pins may be cold-worked or that they may inadvertently be sheared during run-in operations. The run-in forces and hang weight are applied directly onto the shear pins which may cause prestretching or compression. As the overall downhole equipment load supported by the packer increases, the rating of the shear pins must also be increased. In some equipment combinations, the hang load is so great that shearing of the pins becomes very difficult to achieve by hydraulic means alone, and a combination of hydraulic and mechanical means is sometimes required to produce a clean separation.

OBJECTS OF THE INVENTION

It is, therefore, an object of the present invention to provide an improved tool for running and setting a packer in a well bore.

Another object of the invention is to provide an improved hydraulic tool for setting a well packer of the type which is coupled to a work string by shear pins wherein the shear pins are decoupled with respect to run-in handling forces which arise during transit of the packer through a deviated or slanted well bore.

A related object of the invention is to provide an improved tool which utilizes hydraulic forces and reciprocal movement of a work string, without requiring the application of torque, for setting a packer and releasing the service tool from the packer by straight pull-up movement of the service tool, and without requiring the application of torque.

Yet another object of the invention is to provide an improved tool for running and setting a packer in which the hang weight of the packer and attached equipment is supported by the service tool, with the packer being maintained in an unset condition by shear pins which are isolated from the hang weight and from handling forces during run-in and setting of the packer.

SUMMARY OF THE INVENTION

The foregoing objects are achieved according to the present invention in which a packer is run-in and set by a multi-position tool, with the packer being maintained in the unset condition and being connected to the setting tool by a series of shear pins. The shear pins which maintain the packer in the unset condition are decoupled with respect to run-in handling forces by a set of spring loaded transfer lugs carried by the service tool. The support lugs carry the weight of the packer and any weight of equipment hanging below the packer so that no weight is applied to the shear pins during the run-in procedure. This permits the packer to be pushed through restricted or crooked places in the casing without danger of shearing the shear pins.

The support lugs are engaged against a shoulder of the packer tube guide by a movable collet. Finger portions of the movable collet are supported against deflection from a latch detent position by an annular piston carried on a mandrel of the multi-position tool.

The packer is set by applying hydraulic pressure through the work string and into the annular bore of the piston, which causes the piston to shear the transit pins and remove the support from collet finger portions. Continued movement of the annular piston drives a setting sleeve downwardly against a tube guide of the packer which is movable with respect to the packer mandrel.

The packer mandrel is locked onto the multi-position tool mandrel by a group of separation shear pins. Upon continued movement of the piston, the collet latch portions deflect, permitting the collet to be displaced downwardly relative to the tool mandrel, which releases the spring loaded support lugs out of engagement with the shoulder carried on the tube guide. As a result, the hang weight of the packer is transferred from the lugs to the separation shear pins.

Because the packer mandrel is anchored onto the tool mandrel by the separation shear pins, the packer tube guide continues its downward movement relative to the packer mandrel, which causes the outer parts of the packer guide tube to be driven downwardly in relation to the mandrel which is held stationary by the separation shear pins. The slips are engaged and set against the well bore as the piston nears the limit of its extension.

Once the desired slip setting pressure has been achieved and the packer is securely anchored in place, the setting tool is released from the packer by increasing the hydraulic pressure to a predetermined level or by pulling the work string upwardly to cause shearing of the separation shear pins. The spring loaded transfer lugs retract radially inwardly to permit unrestricted movement of the service tool relative to the packer tube guide. The packer tube guide is held securely in place against the packer mandrel by an internal locking slip ring assembly. By continuing to apply fluid pressure through the work string and into the service tool, the ball seat is sheared out, permitting circulation flow.

It will be appreciated that the foregoing packer setting operation is carried out without requiring the application of torque, and only requiring the application of hydraulic pressure or lifting forces on the work string, or both. Moreover, the hang weight of the packer and equipment attached to the packer is supported entirely by the transfer lugs, which effectively decouple handling forces with respect to the separation shear pins.

Other objects and advantages of the present invention will be appreciated by those skilled in the art upon reading the detailed description which follows with reference to the attached drawings.

DETAILED DESCRIPTION OF THE PREFERRED EMBODIMENT

Figure 1:
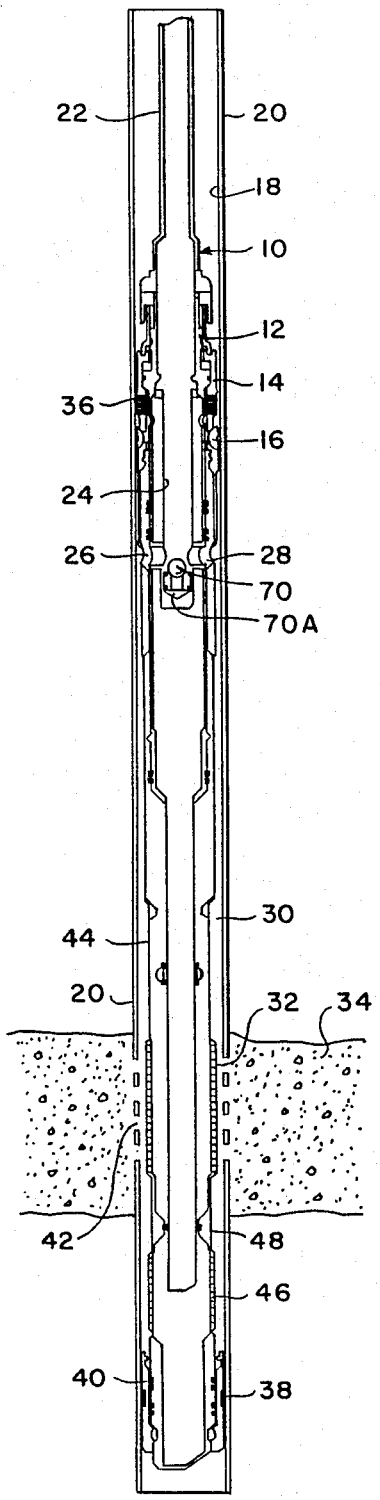
FIG. 1 is a simplified view, partly in section and partly in elevation, showing a typical gravel pack well installation in which the multi-position service tool of the present invention is incorporated.

In the description which follows, like parts are marked throughout the specification and drawings with the same reference numerals, respectively.

Referring now to FIG. 1, operation of the multiposition service tool 10 will be explained with reference to a typical gravel pack service operation in which the tool 10 is landed within the bore 12 of a packer 14. The packer 14 has hydraulically actuated slips 16 which set the packer against the inside bore 18 of a tubular well casing 20. The service tool 10 is sealed against the bore of the packer for delivering a gravel slurry pumped through the work string 22 and bore 24 of the service tool through lateral flow passages 26 which intersect the sidewall of the tool 10, and which communicate with lateral flow passages 28 which intersect the sidewall of the packer 12. The annulus 30 between the casing 20 and sand screen 32 is sealed above and below a producing formation 34 by expanded annular seal elements 36 carried on upper packer 14 and expanded annular seal elements 38 carried on sump packer 40. During the gravel pack operation, the annulus 30 is filled with slurry, and the slurry is pumped through perforations 42 formed in the sidewall of the well casing 20 into the surrounding formation 34.

Figure 2:
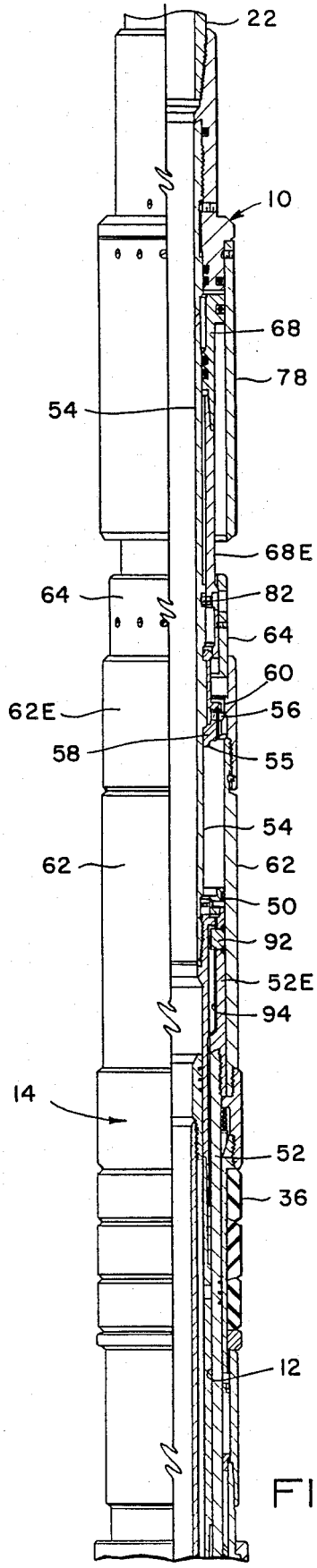
FIG. 2 is a view, partly in elevation and partly in section, which illustrates the position of the multi-position tool relative to the packer during a run-in operation.
Figure 3:
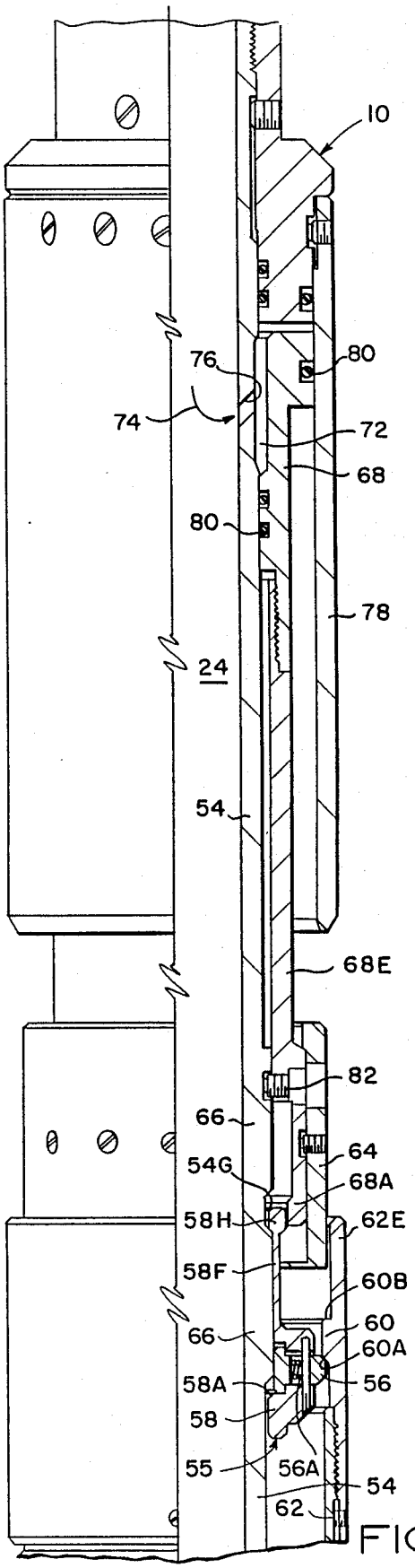
FIG. 3 is a view, partly in section and partly in elevation, showing details of an annular piston and support lug assembly.
Figure 4:
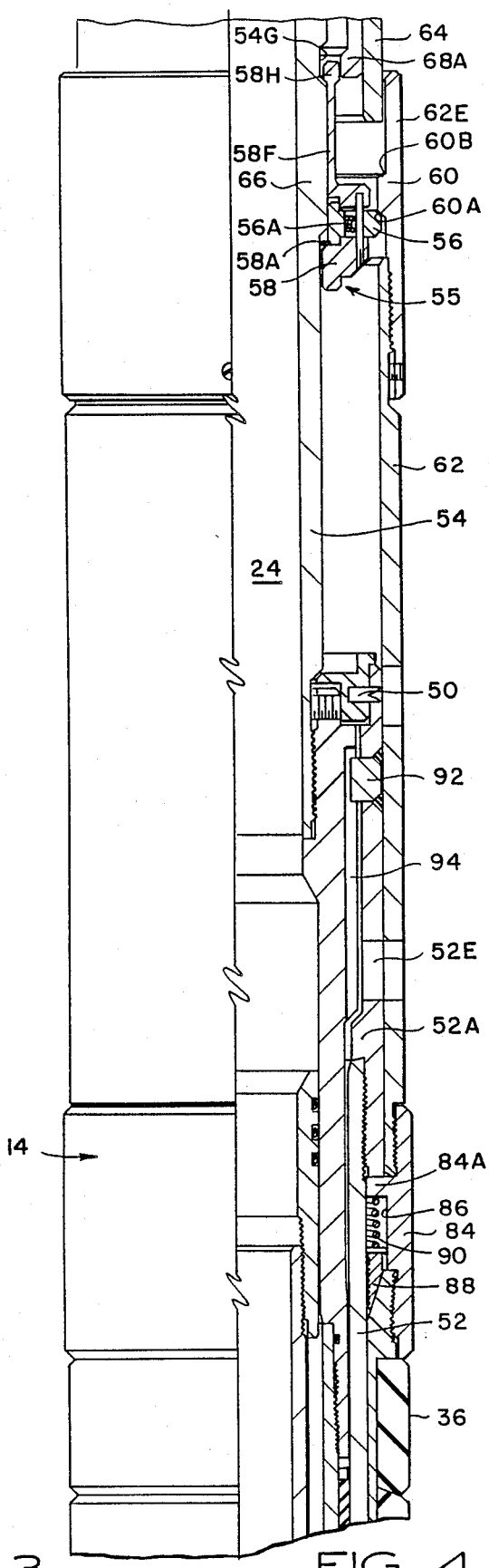
FIG. 4 is a continuation of FIG. 3 which illustrates the relative position of the transit lugs with respect to separation shear pins during a run-in operation.

Referring now to FIGS. 2, 3 and 4, the service tool 10 is rigidly locked onto the packer 14 during the initial run-in operation. According to this arrangement, the service tool 10, packer 14 and all the equipment which is hung off of the packer are run-in through the bore 18 of the casing 20 as an assembled unit. In this instance, the sand screen 32 is hung off of the packer 14 by a length of blank pipe 44 and a tail screen 46 is connected to the sand screen by a polished nipple 48. It will be appreciated that the hang weight of the packer, along with the downhole equipment attached to it, is substantial.

A group of separation shear pins 50 having appropriate shear strength for supporting the packer assembly hang weight connect the packer mandrel 52 to the service tool mandrel 54. During run-in, the packer 14 is mechanically locked in the unset condition by the separation shear pins 50. The shear pins 50 are rated to safely support the combined weight of the downhole equipment, and are rated to yield to a preset shearing force to separate and release the service tool 10 from the packer 14 after the packer has been set.

According to the present invention, the separation shear pins 50 which maintain the packer in the unset condition are decoupled with respect to run-in handling forces by a transfer support assembly 55 which includes a group of transit support lugs 56 which are carried by a collet 58 which is movably mounted onto the service tool mandrel 54. The lugs 56 carry the weight of the packer and any weight of equipment hanging from the packer so that no weight is applied to the separation shear pins 50 during the run-in procedure.

The transit support lugs 56 are engaged against an annular flange 60 which is formed on a tube guide extension 62E. The transit support lug 56 engages the underside 60A of the flange 60, with the upper surface 60B of the shoulder being aligned for engagement with a setting sleeve 64. The hang weight of the packer 14 is transmitted through the tube guide 62 and through the transit lugs 56 and collet 58 to the service tool mandrel 54. That is, the packer and equipment attached to it are supported by the work string 22 through the service tool mandrel 54, the transit lugs 56 and the packer tube guide 62, with the result that handling forces which arise during the run-in procedure are decoupled with respect to the separation pins 50.

The service tool 10 is provided with a locking flange 66 which is engaged by a shoulder portion 58A of the collet 58 to limit its upward movement thereto. The collet is held in its position shown in FIGS. 3 and 4 by its finger portions 58F having their head portions 58H received in a detent groove 54G formed in the service tool mandrel 54 above the shoulder of the locking flange 66. The head portion 58H is engaged and prevented from deflecting by a piston shoulder 68A which forms a part of an annular piston 68 mounted for sliding movement along the service tool mandrel 54.

The transit lugs 56 are released and the packer is set by dropping a ball 70 through the work string 22 and into the bore 24 of the service tool. Pressurized fluid pumped down the work string 22 enters an annulus 72 formed between the piston 68 and the service tool mandrel 54. The pressurized fluid as indicated by the arrow 74 enters the annulus 72 through a port 76 formed in the tool mandrel 54.

The piston 68 is guided for movement along the external surface of the tool mandrel 54 by a cylinder 78. The piston annulus 72 is sealed along the inside bore of the cylinder 78 and along the external surface of the tool mandrel 54 by seals 80. Movement of the piston 68 is initially opposed by a group of transit shear pins 82.

As shown in FIG. 3, the piston 68 has an extension sleeve 68E which is attached to the tool mandrel locking ring 66 by the transit shear pins 82.

The packer is set by increasing the hydraulic pressure to a level great enough to cause the transit shear pins 82 to shear, thereby releasing the piston 68 and permitting it to drive the setting sleeve 64 downwardly against the shoulder 60 of the tube guide extension 62E. The collet 58 remains in place as the piston is driven downwardly. The piston shoulder 68A clears the collet head 58H, thereby permitting it to deflect and also permitting the collet transfer assembly to move downwardly along the locking ring 66, and permitting the spring loaded support lugs 56 to retract radially inwardly. When this occurs, the hang weight of the packer is transferred from the lugs to the separation pins 50.

Figure 5:
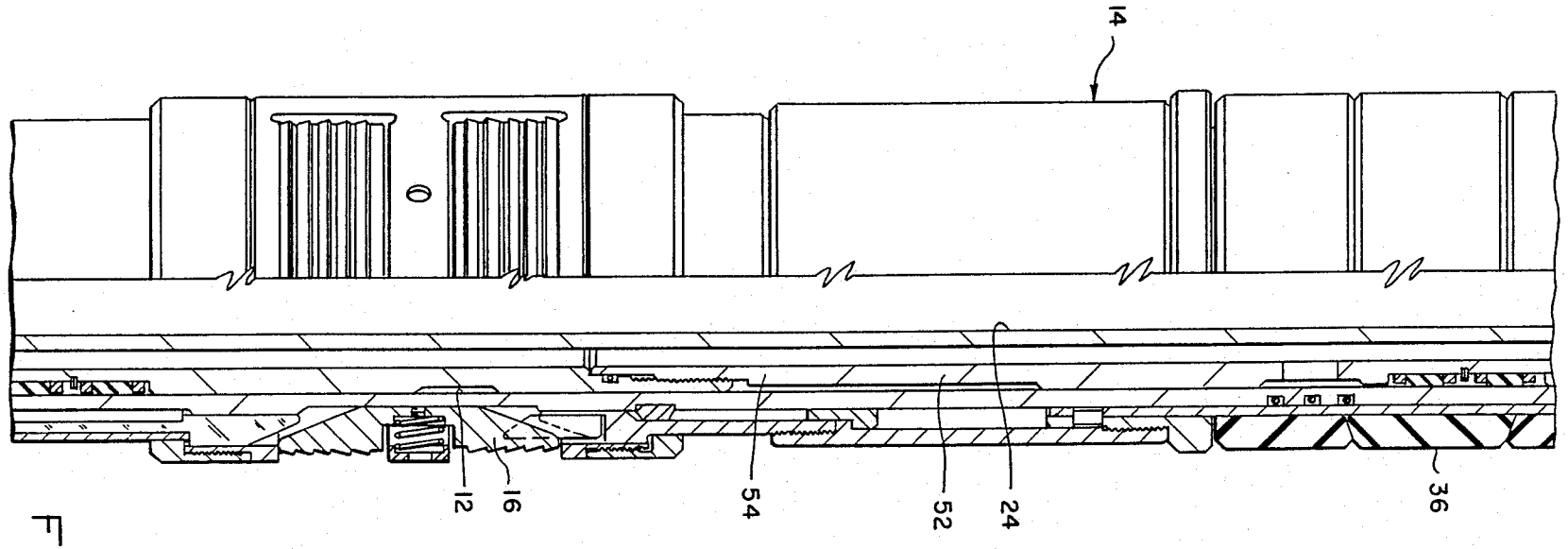
FIG. 5 illustrates the position of the packer tube guide as driven by the annular piston for engaging packer slips.

Referring now to FIGS. 4 and 5, the tube guide 62 is movable relative to the packer mandrel 52. The seal 36 and slips 16 are connected to the tube guide 62 by a connecting sub 84. Confined within an annulus 86 formed between the connecting sub 84 and the packer mandrel 52 is an internal locking slip ring assembly 88. The slip ring assembly 88 is biased by a coil spring 90 which is combined between the locking ring 88 and an annular shoulder portion 84A of the connecting sub. The annular locking ring 88 functions as an internal slip which prevents reverse movement of the tube guide assembly relative to the packer mandrel 52. Accordingly, the tube guide assembly is moved downwardly relative to the packer mandrel 52 in response to continued extension of the piston 68. As the piston 68 nears the limit of its extension along the service tool mandrel 54, the slips 16 are engaged and set against the inside bore 18 of the well casing 20.

Because the packer mandrel 52 is anchored onto the tool mandrel 54 by the separation shear pins 50, the packer tube guide 62 continues its downward movement relative to the packer mandrel. Once the desired slip setting pressure has been achieved and the packer 14 is securely anchored in place, the setting tool 10 can then be released from the packer by increasing the hydraulic pressure and/or by pulling the work string 22 upwardly to cause shearing of the separation shear pins 50.

The transfer support lugs 56 are fully retracted radially inwardly by a spring 56A, thereby permitting the service tool 10 to be reciprocated freely within the packer bore 12. A pin 92 which projects into the bore of the packer mandrel extension 52E, with its inner end received within a locator slot 94, permits torque to be transmitted therethrough, if necessary, to aid in the running operation. By continuing to apply fluid pressure through the work string 22 and into the service tool bore 24, the seat 70A of the ball 70 is sheared out, thereby permitting circulation flow for carrying out a gravel pack operation.

According to the foregoing arrangement, the service tool 10 attaches to the packer 14 in such a way that the packer can be run, set and the tool released from the packer without any kind of rotation of the tool itself. The packer load is transferred from the separation shear pins by the transfer support lugs. Accordingly, any weight hanging below the packer is not applied to the separation shear pins during the run-in procedure. The transfer support lugs are locked in the supporting position during transit by the set of transit shear pins which lock an annular piston onto the tool mandrel. Movement of the piston in response to the application of hydraulic pressure causes the pins to shear, with the result that the collet which holds the transfer support lugs in place becomes unsupported, thereby permitting the collet to carry the support lugs to a new position which permits the transfer lugs to retract, thereby transferring the hang weight to the separation shear pins.

Continued movement of the piston downwardly brings the setting sleeve of the service tool to bear against the guide of the packer, thereby moving the outer parts of the packer relative to the mandrel, and in doing so, expanding the seals and setting the slips. After the packer slips have been securely set and the annular seal elements 36 and 38 have been expanded, the separation pins 50 are sheared by an increase in hydraulic pressure and/or a simple upward pulling force applied to the work string 22. Movement of the service tool is then possible by straight up or down movement of the work string at the surface.

As a result of the unique packer and service tool combination, the load of the packer is borne by the transfer support lugs and not by the separation shear pins. Another important feature of this arrangement is that if it is necessary to push the packer against a binding force, the pushing forces are directed through the annular shoulder 52A of the packer mandrel extension and are applied through the service tool mandrel and through the packer mandrel, and not directed through shear pins. By this arrangement, pre-stretching and compression of the shear pins are avoided.

Although the invention has been described with reference to a specific embodiment, and with reference to a specific gravel pack operation, the foregoing description is not intended to be construed in a limiting sense. Various modifications of the disclosed embodiments as well as alternative applications of the invention will be suggested to persons skilled in the art by the foregoing specification and illustrations. It is therefore contemplated that the appended claims will cover any such modifications, applications or embodiments as fall within the true scope of the invention.

What is claimed is:

1. In a subterranean well having a perforated casing adjacent to a producing formation, a packer engaging said casing above the producing formation and having a mandrel supporting a screen within the perforated zone of the casing, and having a slip actuator and a slip means movable coupled on said packet mandrel for setting said slip against said casing, and service tool having a mandrel removably inserted within the bore of the packet mandrel for performing a service operation, the improvement comprising:

a group of separation shear pins joining the packet mandrel to the service tool mandrel;

a transfer support assembly movably mounted onto said service tool mandrel for reciprocal movement relative thereto, said transfer support assembly including a retractable transfer support lug, said transfer support assembly being movable from a support position in which said transfer support lug is disposed in locking engagement with the slip actuator means, with the transfer support assembly being disposed in locking engagement with the service tool mandrel, and which is movable to a release position in which the transfer support lug is retracted out of locking engagement with the slip actuator means; and, an annular piston movably mounted on said service tool mandrel for extension and retraction relative to said service tool mandrel, said annular piston having a sleeve member for engaging said transfer support assembly and being movable to a retracted position in which said sleeve member is disposed in latching engagement with the transfer support assembly to prevent reciprocal movement of the transfer support assembly, and said piston being movable in response to the application of hydraulic pressure against said piston to an extended position in which the transfer support assembly is disengaged from said sleeve member and is free to move along said service tool mandrel to permit retraction of said transfer lug out of engagement with the slip actuator means.

2. The improvement as defined in claim 1, said transfer support assembly comprising a collet having an annular body member and flexible fingers projecting from said annular body member, said flexible finger members having head portions for engaging said service tool mandrel, said service tool mandrel having an annular locking shoulder, with the head portions of said collet fingers being disposed in locking engaging means said annular shoulder when said collet is in the transfer support position.

3. The improvement as defined in claim 1, including a group of transmit shear pins joining said annular piston to said service tool mandrel.

4. Well service apparatus for treating a producing formation surrounding a perforated zone of a subterranean well comprising, in combination:

a packet including a mandrel, anchoring and sealing means for securing said packer in a well casing and sealing therebetween; means for actuating the anchoring and sealing means; a tubular support sub attached and depending from the packet mandrel, said support sub including a lower perforated portion through which fluid can flow between the well bore and the bore of the support sub; a service tool disposed within said packer mandrel and having an inner mandrel coupled in communication with a work string extending through the well casing to the surface; a group of separation shear pins connecting the service tool mandrel to the packer mandrel; a transfer support assembly movably mounted on said service tool mandrel, said transfer support assembly including a group of transfer support lugs releasably connecting the actuator means to the service tool mandrel; and, an annular piston mounted for extension and retraction along said service tool mandrel for locking and releasing said transfer support lugs in response to extension and retraction of said piston.

5. In combination:

a packet including a mandrel, anchoring and sealing means for securing said packet in a well casing and sealing therebetween, and means for actuating and setting the anchoring and sealing means;

a service tool having a mandrel disposed within said packer mandrel;

a group of separation shear pins connecting said packer mandrel to said service tool mandrel;

a group of transfer support lugs releasably connecting said actuator means to said service tool mandrel; and, an annular piston mounted for extension and retraction along said service tool mandrel for locking and releasing said transfer support lugs in response to extension and retraction of said piston.

6. The combination as defined in claim 5, including:

a transfer support assembly movably mounted onto said service tool mandrel, said transfer support assembly carrying said transfer support lugs, said transfer support assembly being movable from a support position in which said transfer support lugs are disposed in locking engagement with said actuator means, and with the transfer support assembly being disposed in locking engagement with the service tool mandrel, and being movable to a release position in which the transfer support lugs are retractable out of locking engagement with the actuator means.

7. The combination as defined in claim 5, wherein said annular piston is movable to a retracted position in which it is disposed in latching engagement with the transfer support assembly to prevent reciprocal movement of the transfer support assembly, and which is extendable in response to the application of hydraulic pressure against said piston to an extended position in which the transfer support assembly is disengaged and is free to move along said service tool mandrel to permit retraction of said transfer support lugs out of engagement with the actuator means.

8. A method for supporting a service tool and packer from a work string within the bore of a subterranean well comprising the steps:

suspending the service tool from the work string;

inserting the service tool within the bore of the packer;

securing the service tool to the packer with a group of shear pins;

carrying the hang weight of the packet on transfer support lugs carried by the service tool;

engaging the packer against the bore of the well and transferring its hang load from the transfer support lugs to the separation shear pins after the packer has been set;

releasing the service tool from the packer by shearing said group of shear pins.

9. In a subterranean well having a perforated casing adjacent to a producing formation, a packer engaging said casing above the producing formation and having a mandrel supporting a screen within the perforated zone of the casing, and having a slip and actuator means movably coupled on said packer mandrel for setting said slip against said casing, and a service tool having a mandrel removably inserted within the bore of the packer mandrel for performing a well service operation, the improvement comprising:

a group of separation shear pins joining the packer mandrel to the service tool mandrel;

a transfer support assembly movably mounted onto said service tool mandrel, said transfer support assembly including a retractable transfer support lug, said transfer support assembly being movable from a support position in which said transfer support lug is disposed in supporting engagement with the slip actuator, with the transfer support assembly being disposed in locking engagement with the service tool mandrel, and which is movable to a release position in which the transfer support lug is retracted out of supporting engagement with the slip actuator;

said transfer support assembly including a collet having an annular body portion mounted about said service tool mandrel, said support lug being mounted for radial retraction through said collet body, and including a spring disposed between said collet body and said lug for biasing the lug for engagement against the service tool mandrel and for retraction away from the packer slip actuator means; and, an annular piston mounted for extension and retraction along said service tool mandrel, said annular piston being movable to a retracted position in which it is disposed in latching engagement with the transfer support assembly to prevent reciprocal movement of the transfer support assembly, and which is extendable in response to the application of hydraulic pressure against said piston to an extended position in which the transfer support assembly is disengaged and is free to move along said service tool mandrel to permit retraction of said transfer lug out of engagement with the slip actuator means.

10. The improvement as defined in claim 9, said transfer support assembly comprising a collet having an annular body member and flexible fingers projecting from said annular body member, said flexible finger members having head portions for engaging said service tool mandrel, and said service tool mandrel having an annular locking shoulder, with the head portions of said collet fingers being disposed in locking engagement against said annular shoulder when said collet is in the transfer support position; and, said annular piston having an annular latching portion disposed adjacent said flexible finger members for opposing radial deflection of said head portions when said annular piston is in its retracted position and said transfer support assembly is in its support position.

11. In combination:

a packer including a mandrel, anchoring and sealing means for securing said packer in a well casing and sealing therebetween, and means for actuating and setting the anchoring and sealing means;

a service tool having a mandrel disposed within said packer mandrel;

a group of separation shear pins connecting said packer mandrel to said service tool mandrel;

a group of transfer support lugs releasably connecting said actuator means to said service tool mandrel;

an annular piston mounted for extension and retraction along said service tool mandrel for locking and releasing said transfer support lugs in response to extension and retraction of said piston;

a transfer support assembly movably mounted onto said service tool mandrel, said transfer support assembly carrying said transfer support lugs, said transfer support assembly being movable from a support position in which said transfer support lugs are disposed in locking engagement with said actuator means, and with the transfer support assembly being disposed in locking engagement with the service tool mandrel, and being movable to a release position in which the transfer support lugs are retractable out of locking engagement with the actuator means; and, said transfer support assembly comprising an annular body portion mounted about said service tool mandrel, said transfer support lugs being mounted for radial retraction through said body portion, a spring disposed between said annular body portion and each lug for biasing each lug for engagement against the service tool mandrel and for retracting away from engagement against said actuator means, and said service tool mandrel having a radially projecting, annular shoulder which is engaged by said transfer support lugs when said transfer support assembly is in said support position.

12. The improvement as defined in claim 11, said transfer support assembly comprising a collet having an annular body portion mounted about said service tool mandrel and flexible fingers projecting from said annular body member, said service tool mandrel having an annular locking shoulder, a detent groove formed in said locking shoulder, with the head portions of said collet fingers being disposed in locking engagement against said annular shoulder when said collet is in the transfer support position.

* * * * *

UNITED STATES PATENT AND TRADEMARK OFFICE

CERTIFICATE OF CORRECTION

PATENT NO. : 4,832,129

DATED : May 23, 1989

INVENTOR(S) : Sproul et al.

It is certified that error appears in the above-identified patent and that said Letters Patent is hereby corrected as shown below:

At column 3, lines 62-63, "multiposi-tion" should read --multi-position--.

At column 4, line 49, "lug 56 engages" should read --lugs 56 engage--.

In Claim 8, line 9 (column 8, line 51), "packet" should read --packer--.

In Claim 8, line 13 (column 8, line 55), "after" should read --before--.

Signed and Sealed this

Sixteenth Day of March, 1993

*Attest:*

STEPHEN G. KUNIN

*Attesting Officer*

*Acting Commissioner of Patents and Trademarks*